US009882325B2

(12) United States Patent
Lawrence et al.

(10) Patent No.: US 9,882,325 B2
(45) Date of Patent: Jan. 30, 2018

(54) CABLE TRAY ASSEMBLY

(71) Applicant: Molex, LLC, Lisle, IL (US)

(72) Inventors: Tommy Lawrence, Little Rock, AR (US); Javier Resendez, Streamwood, IL (US); Takayuki Arai, Tokyo (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/472,372

(22) Filed: Mar. 29, 2017

(65) Prior Publication Data

US 2017/0288354 A1 Oct. 5, 2017

Related U.S. Application Data

(60) Provisional application No. 62/316,063, filed on Mar. 31, 2016.

(51) Int. Cl.

| | |
|---|---|
| ***H01R 25/00*** | (2006.01) |
| ***H01R 13/73*** | (2006.01) |
| ***H01R 13/6591*** | (2011.01) |

(52) U.S. Cl.

CPC ..... *H01R 25/00* (2013.01); *H01R 13/6591* (2013.01); *H01R 13/73* (2013.01)

(58) Field of Classification Search

CPC ..... H01R 25/00

See application file for complete search history.

(56) References Cited

U.S. PATENT DOCUMENTS

| | | | | | |
|---|---|---|---|---|---|
| 2,502,359 | A * | 3/1950 | Wheeler | H01P 1/183 | 333/159 |
| 3,763,445 | A * | 10/1973 | Hannaford | H01B 11/1895 | 333/160 |
| 5,909,155 | A * | 6/1999 | Anderson | H01R 24/542 | 333/100 |
| 5,973,262 | A * | 10/1999 | Matubara | H01R 4/30 | 361/622 |
| 6,049,709 | A * | 4/2000 | Anderson | H01R 24/50 | 348/E7.053 |
| 6,558,201 | B1 * | 5/2003 | Begley | H01R 31/06 | 439/638 |
| D492,292 | S * | 6/2004 | Ogren | D13/199 | |
| D495,321 | S * | 8/2004 | Ogren | D14/240 | |
| 6,796,844 | B1 * | 9/2004 | Edwards, III | H01R 13/518 | 439/638 |
| 7,128,614 | B1 * | 10/2006 | Wu | H01R 13/6658 | 439/607.01 |
| 7,331,824 | B2 * | 2/2008 | Lin | H01R 13/6658 | 439/470 |
| 2014/0273551 | A1 * | 9/2014 | Resendez | H01R 12/737 | 439/65 |
| 2015/0047276 | A1 * | 2/2015 | Gandolfo | F16L 5/04 | 52/220.8 |

* cited by examiner

*Primary Examiner* — James Harvey
(74) *Attorney, Agent, or Firm* — Jeffery K. Jacobs

(57) ABSTRACT

A cable tray assembly includes a first shell that defines a hollow interior and a second shell that defines a hollow interior, wherein one of the shells is partially inserted into the other shell so that the two hollow interiors are in communication. The shells each include a face that is opposite the face on the other shell and the faces support a plurality of connectors. An adjustment system helps control the distance between the two faces so that the cable tray can connect two row of connectors that are a distance apart where the distance is variable.

10 Claims, 12 Drawing Sheets

CABLE TRAY ASSEMBLY

RELATED APPLICATIONS

This application claims priority to U.S. Provisional Application No. 62/316,063, filed Mar. 31, 2016, which is incorporated herein by reference in its entirety.

TECHNICAL FIELD

This disclosure relates to the field of backplane connectors, more specifically to backplane connectors suitable for use in a mid-plane configuration.

DESCRIPTION OF RELATED ART

As is known, servers and other high performance systems often desire to increase the density of processors. One issue that limits the ability to pack more processing power in a particular box is real estate on the circuit board. Even with 14 nm sized transistors there is a limit to the number of processor cores that can be mounted on a given circuit board configuration. Servers and other high performance computers therefore often use a system that combines a main board with multiple secondary boards to increase the amount of processing power that can be fit within a single box. The secondary boards are often called daughter cards and allow for three-dimensional architecture.

As the systems have become more complicated the system architecture has increased in complexity and now mid-plane designs are common. The mid-plane design essentially places a circuit board between two other circuit boards and thus provides a way to manage all the connections and ensure one processor can communicate with multiple daughter cards (or so that one daughter card can communicate with multiple processors.). Essentially this creates a system where three circuit boards are positioned in a box in a desired configuration and the mid-plane board communicates between two circuit boards.

One issue with existing mid-plane designs is that they have two fixed planes for the connector mating face. As the box is configured to support different circuit boards that are secured into position in the box, the tolerances of positions of the various circuit boards can be difficult to manage.

Due to the need to reduce loss caused by the mid-plane circuit board, certain individuals have taken to using cable-based trays as a substitute for circuit boards. Existing cable tray designs do not allow for the cable tray to absorb positional tolerances (beyond a minor level inherent in the connector) and thus, especially where the mid-plane is used to provide connection between two racks, the mid-plane requires precise control over the endpoint position. Certain individuals would therefore appreciate improvements in the mid-plane tray design.

SUMMARY

A cable tray assembly is provided with a first shell with a first face and a second shell with a second face, where one of the shells is partially inserted into the other shell so that the first face and second face are on opposite sides of the cable tray assembly. The cable tray assembly includes an adjustment system that can absorb variances in the positions of the first face and the second by precise screw adjustment or telescopic shaft that can optionally including a biasing member. The adjustment system allows the cable tray assembly to be inserted in between the two racks and then expanded until both the first and second faces are position so that connectors supported by the cable tray assembly can mate with connectors supported by a chassis. Adjustability also enables a single cable tray assembly to meet multiple mating face to mating face dimensions or wipe length requirements.

BRIEF DESCRIPTION OF THE DRAWINGS

The present application is illustrated by way of example and not limited in the accompanying figures in which like reference numerals indicate similar elements and in which.

DETAILED DESCRIPTION

Figure 1:
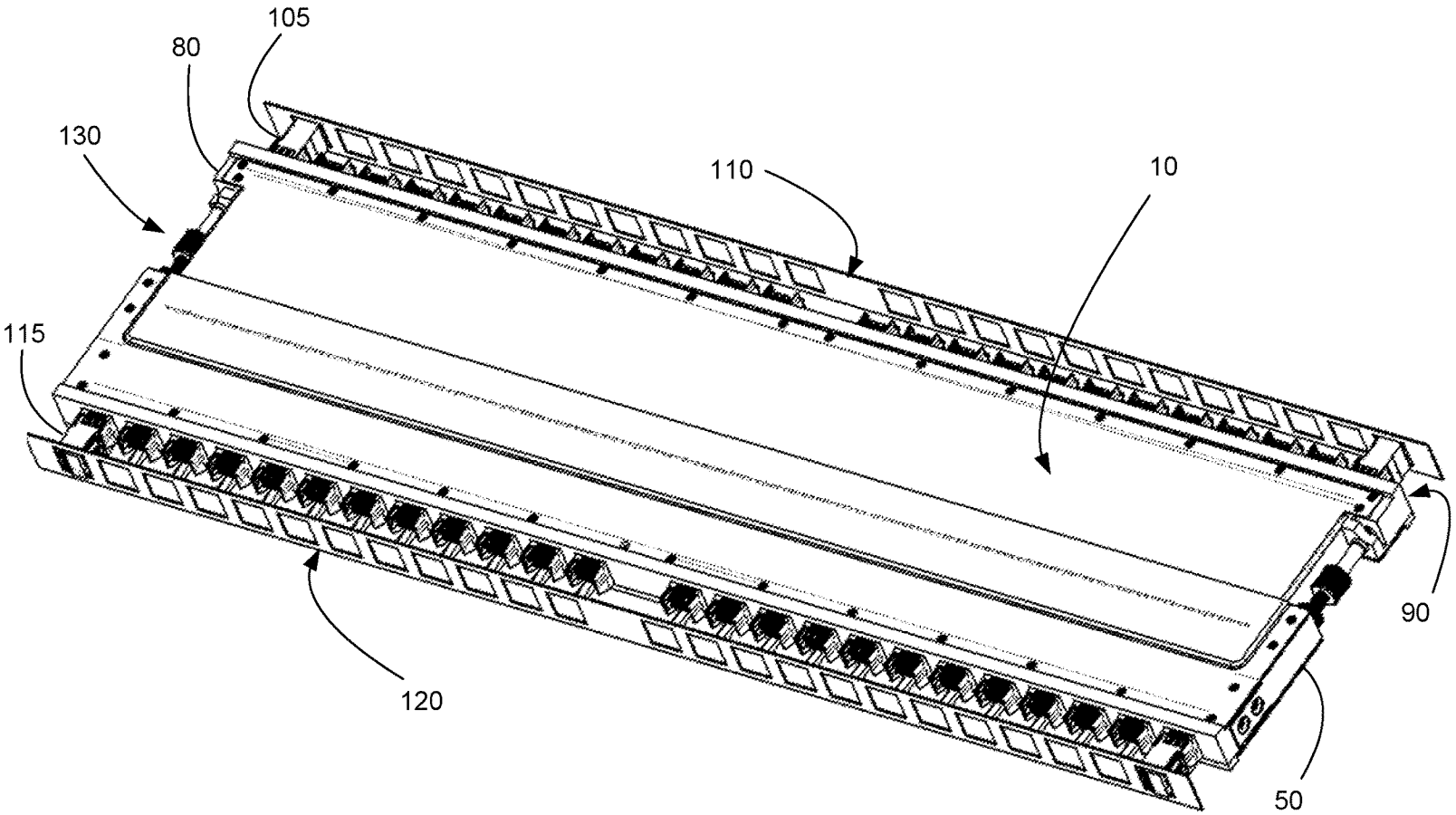
FIG. 1 illustrates a perspective view of an embodiment of a cable tray assembly engaging two mating faces.
Figure 2:
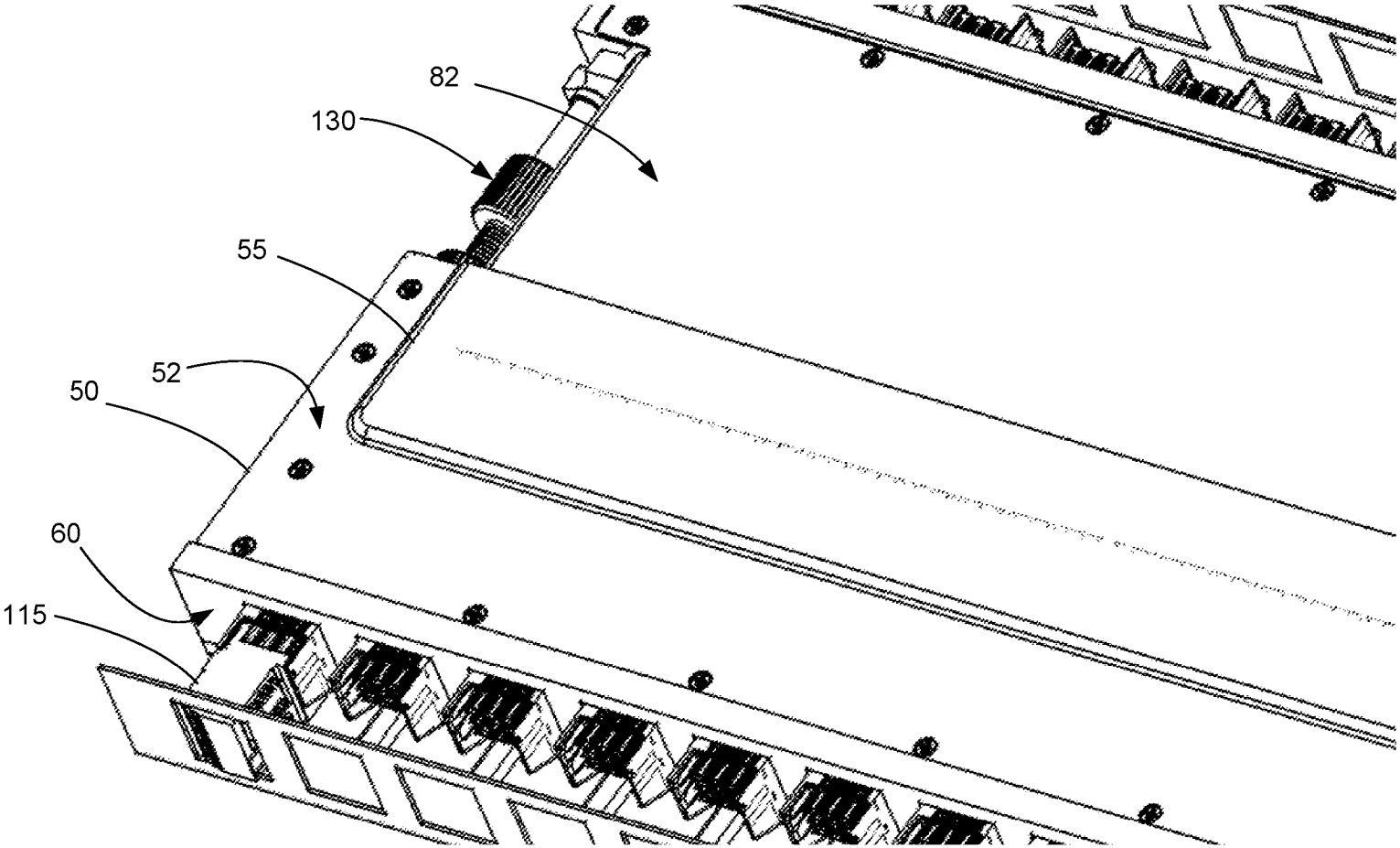
FIG. 2 illustrates a perspective enlarged view of the embodiment depicted in FIG. 1.
Figure 3:
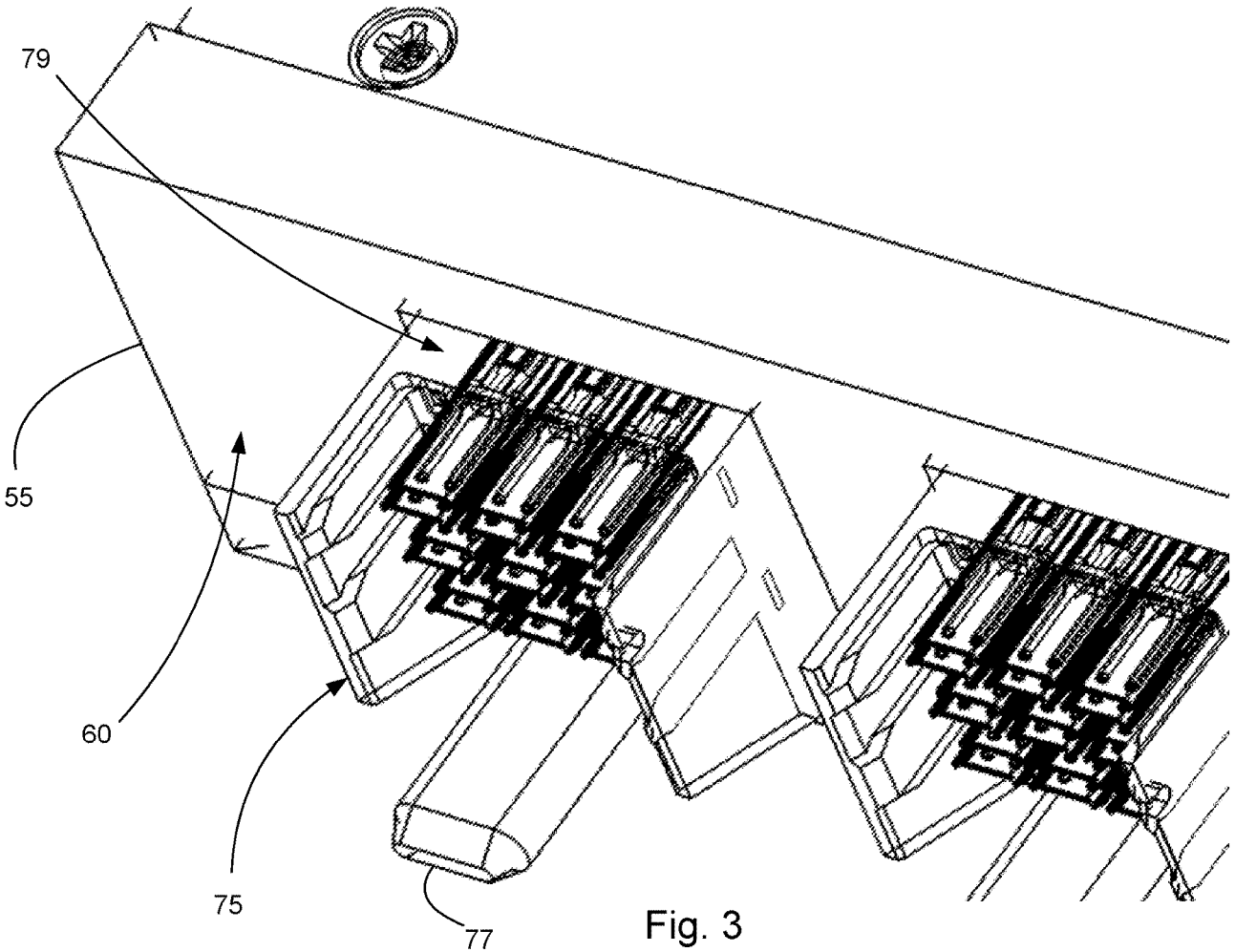
FIG. 3 illustrates a perspective view of an embodiment of a connector mounted in a face of a cable tray assembly.
Figure 4:
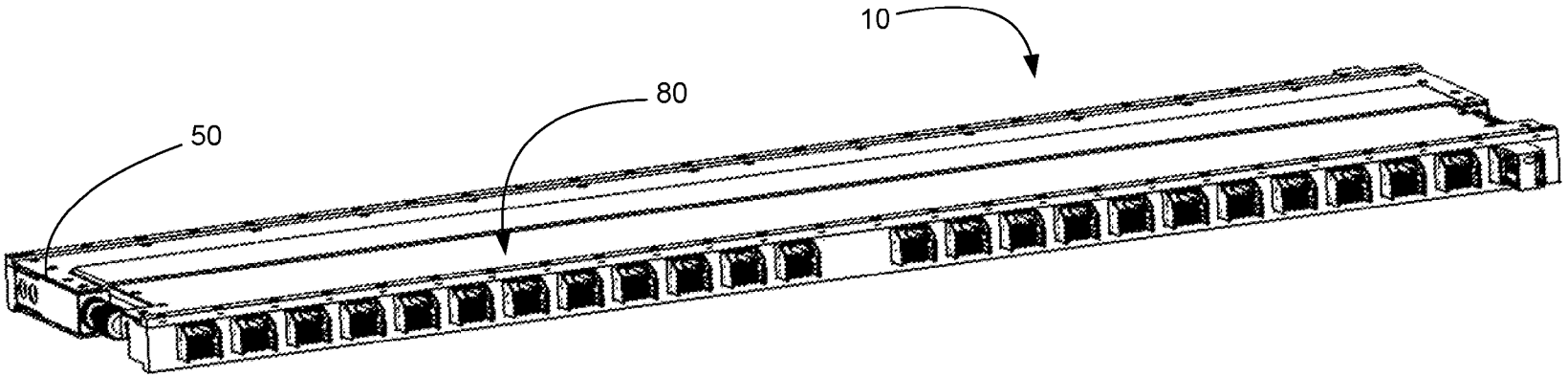
FIG. 4 illustrates a perspective view of an embodiment of a cable tray assembly.
Figure 5:
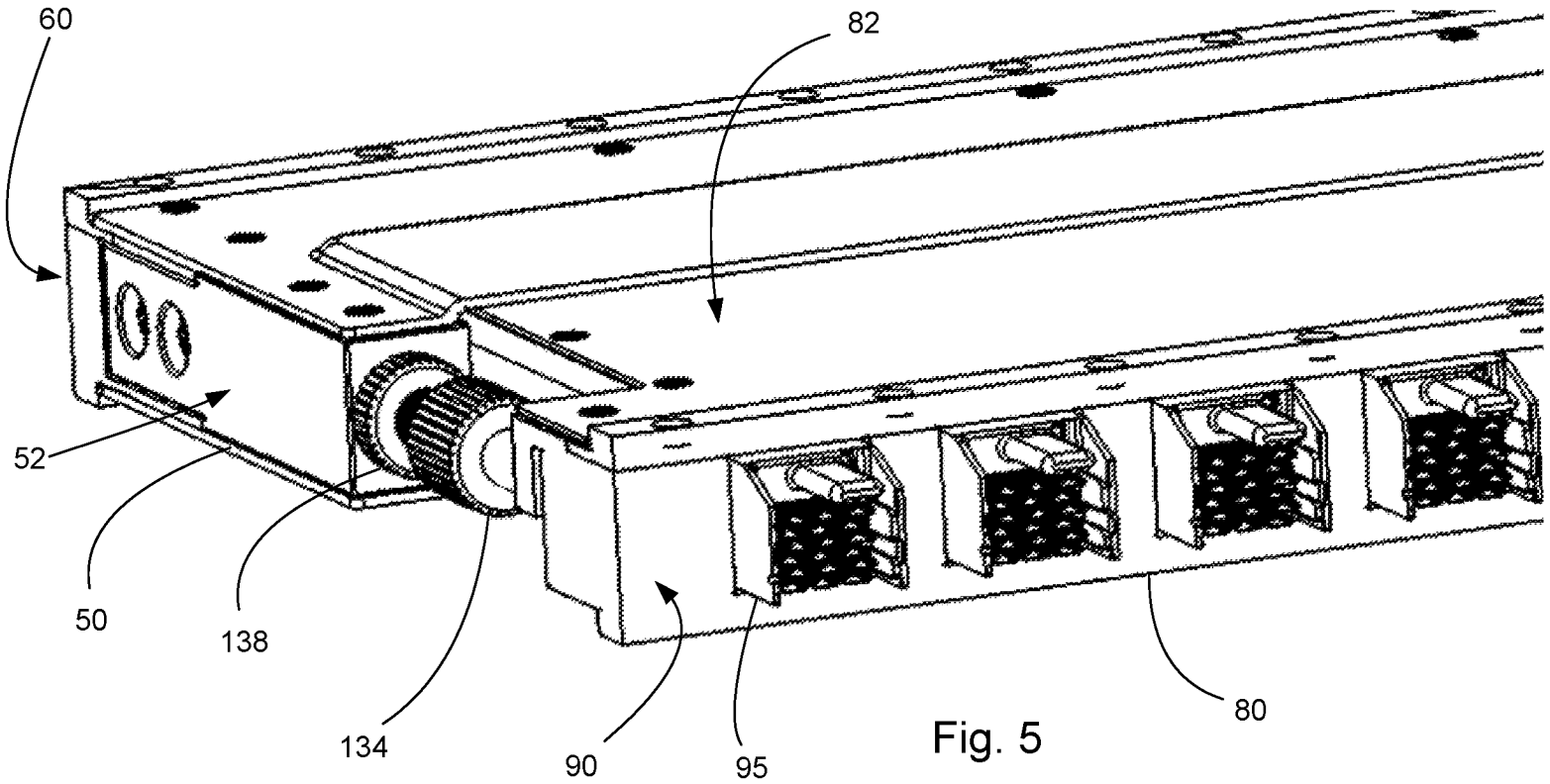
FIG. 5 illustrates an enlarged perspective view of the embodiment depicted in FIG. 4.
Figure 6:
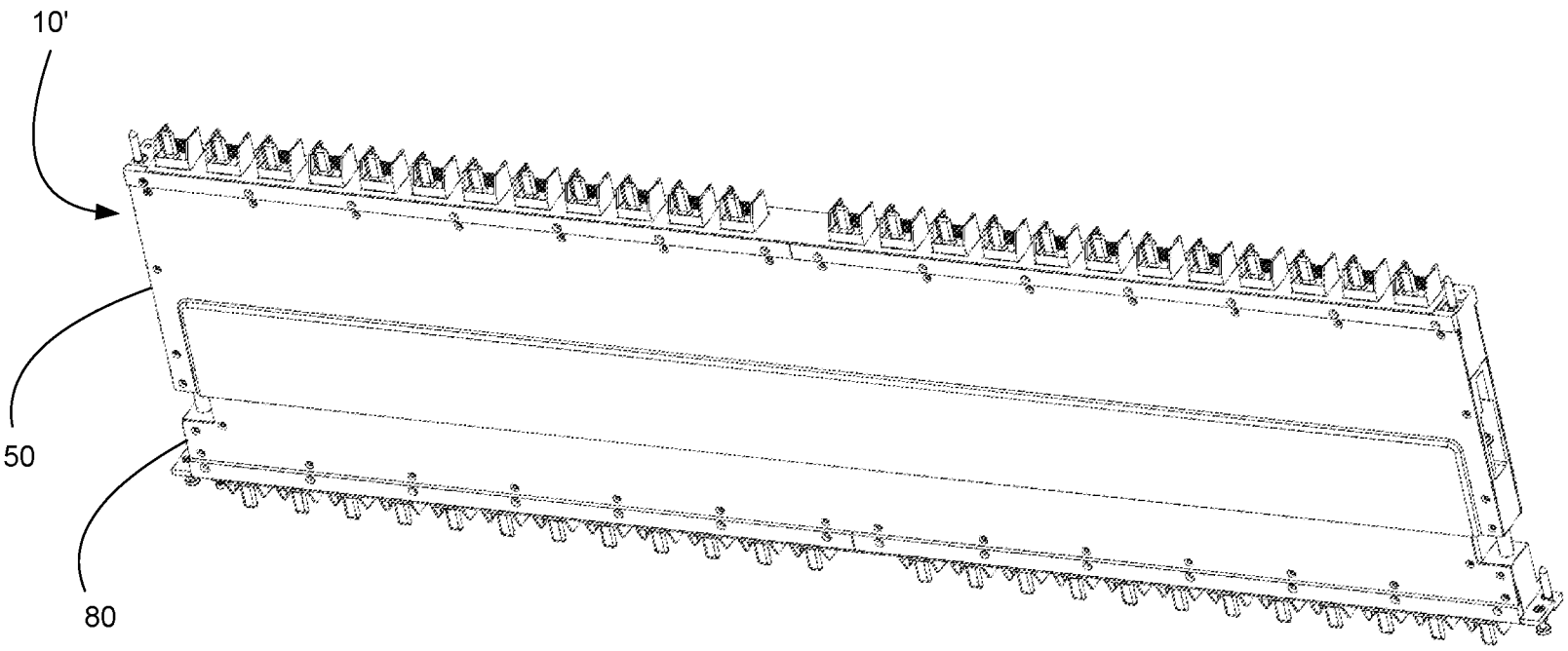
FIG. 6 illustrates a perspective view of another embodiment of a cable tray assembly.
Figure 7:
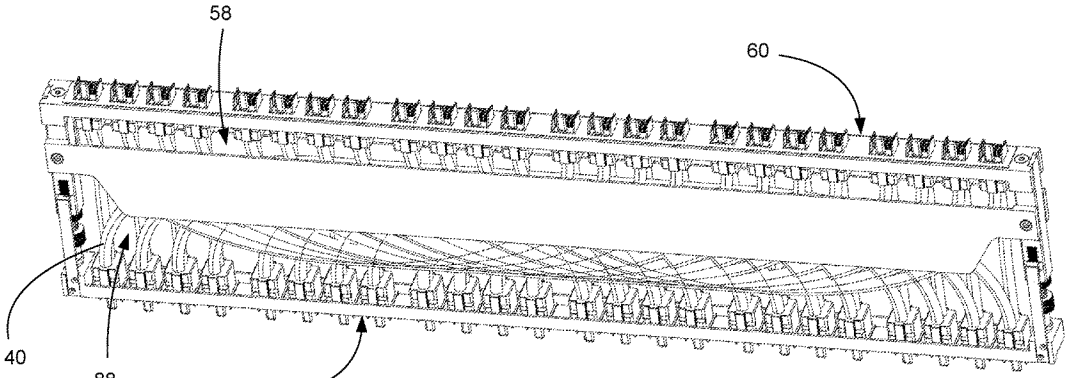
FIG. 7 illustrates a perspective partially cutaway view of an embodiment of a cable tray assembly.
Figure 8:
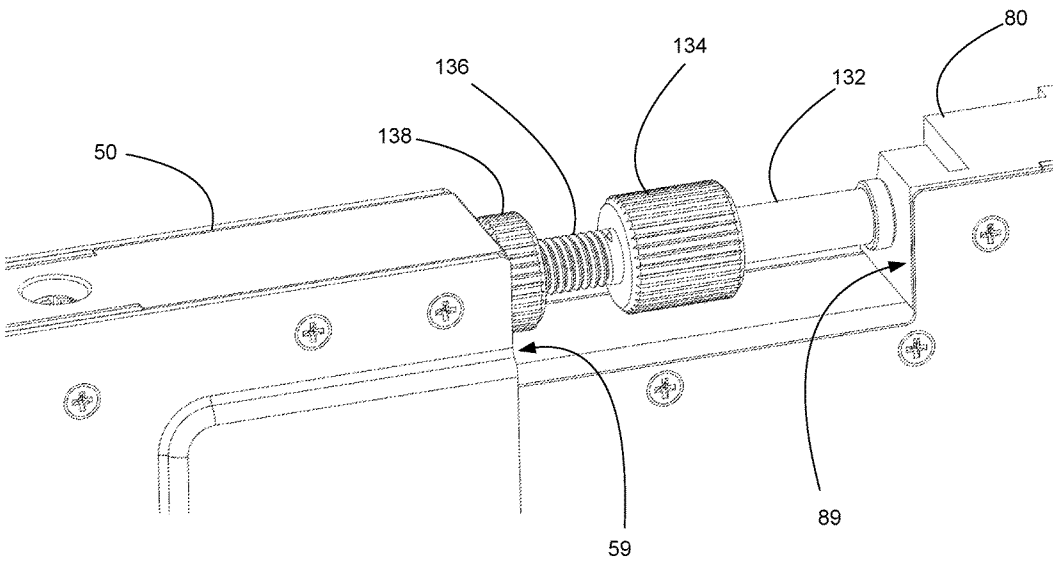
FIG. 8 illustrates a perspective view of an embodiment of an adjustment system.
Figure 9:
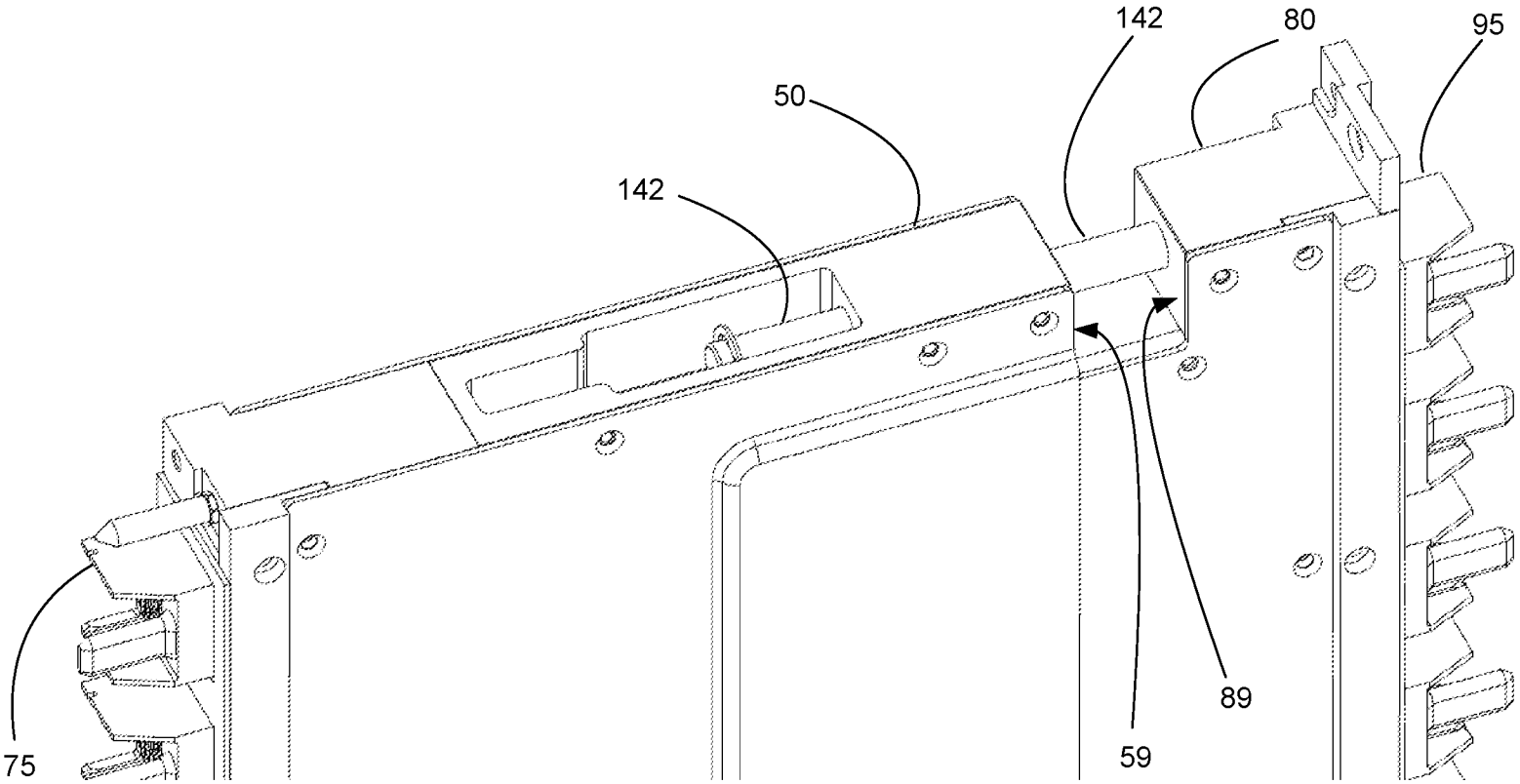
FIG. 9 illustrates a perspective view of another embodiment of an adjustment system.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

As can be appreciated from FIGS. 1-12, a cable tray assembly (CTA) 10 includes a shell 50 and a shell 80 that is inserted into the shell 50 so that the CTA 10 can engage mating faces 110 and 120 that may have some variation in position, relative to each other compared to the planned position. The mating face 110 will include connectors 105 and the mating face 120 will include connectors 115 and both that connectors are configured to engage connectors provided by the CTA 10. The CTA 10 includes a first face 60 on the shell 50 and a second face 90 on the shell 80 that are on opposing sides of the CTA 10. Beneficially, the relative position of the first and second faces 60, 90 can be adjusted to compensate for position tolerance of the mating faces 110, 120.

As can be appreciated, the shell 50 includes a plurality of sides 52 that define an interior cavity 58 and the shell 80 includes a plurality of sides 82 that define an interior cavity 88. Connectors 75 are mounted on the face 60 and connectors 95 are mounted on the face 90. In one embodiment the connectors on both faces 60, 90 can be the same but in other embodiments the connectors on each face can very. In addition, the connectors on one of the faces can also vary as desired to as to provide a flexible CTA 10. The depicted connectors 75 include an alignment peg 77 and an array of signal terminals 79 and the connectors 95 can be configured in the same manner.

The depicted shell 50 has an expanded portion 55 that is configured to accept the shell 80. It has been determined that such a configuration makes it easier to manage the cable routing. Alternative configurations where is no expanded section because it is larger would also be suitable so long as the edge of the first shell being inserted into the second shell was deburred so that the cables were not damaged during adjustment of the CTA 10.

Figure 10:
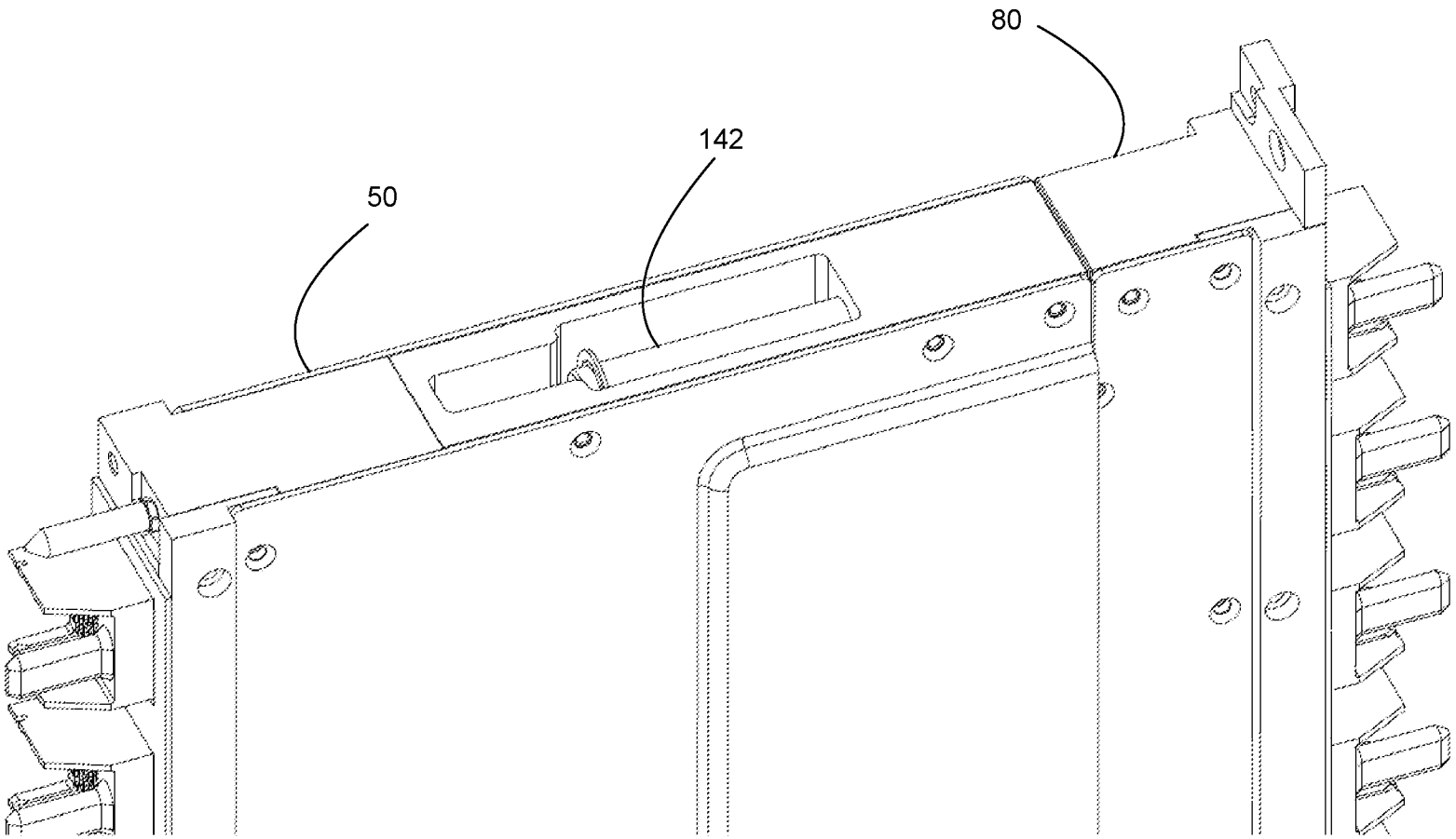
FIG. 10 illustrates a perspective view the embodiment depicted in FIG. 9 with the cable tray assembly in a compressed state.
Figure 11:
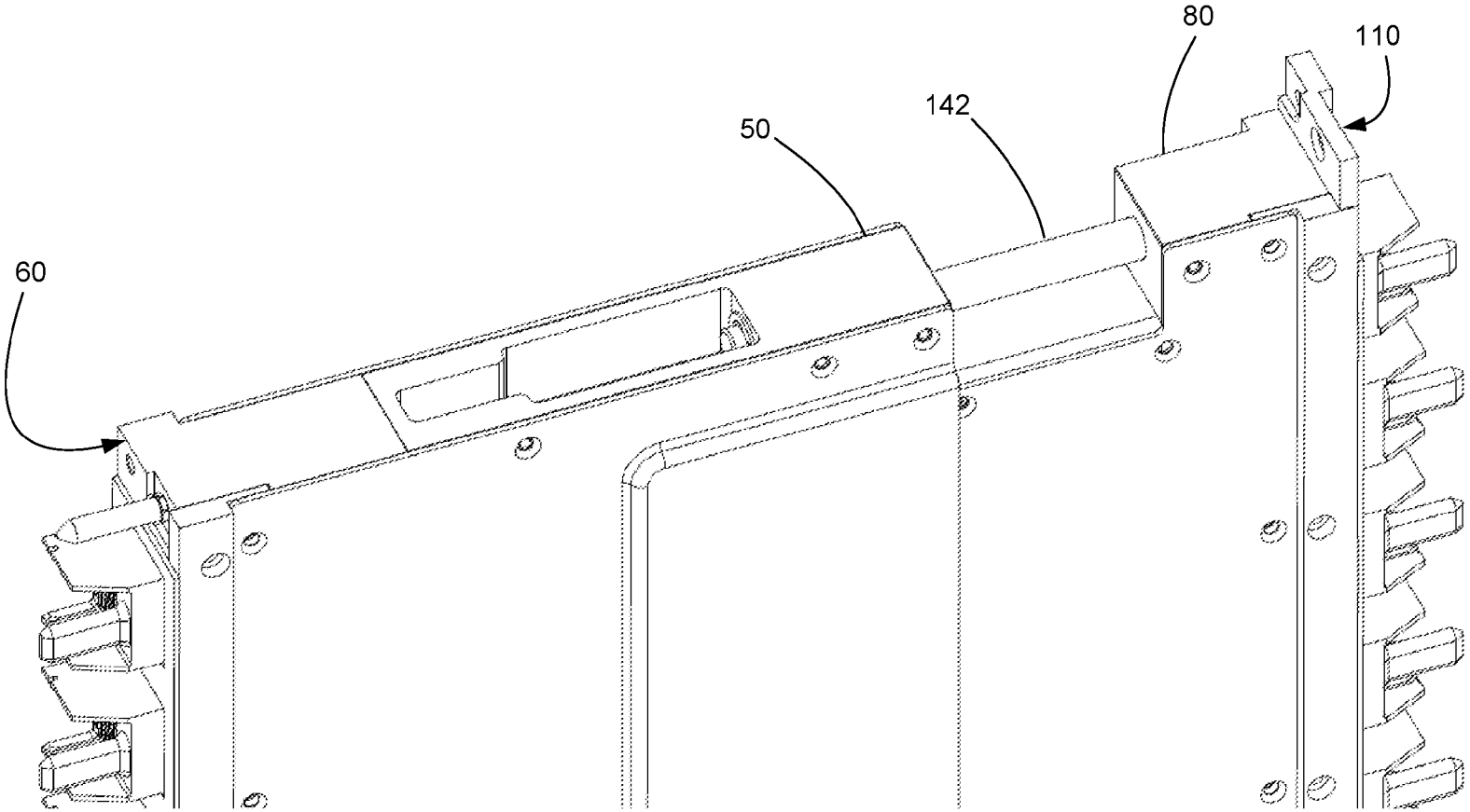
FIG. 11 illustrates a perspective view of the embodiment depicted in FIG. 9 with the cable tray assembly in an expanded state.
Figure 12:
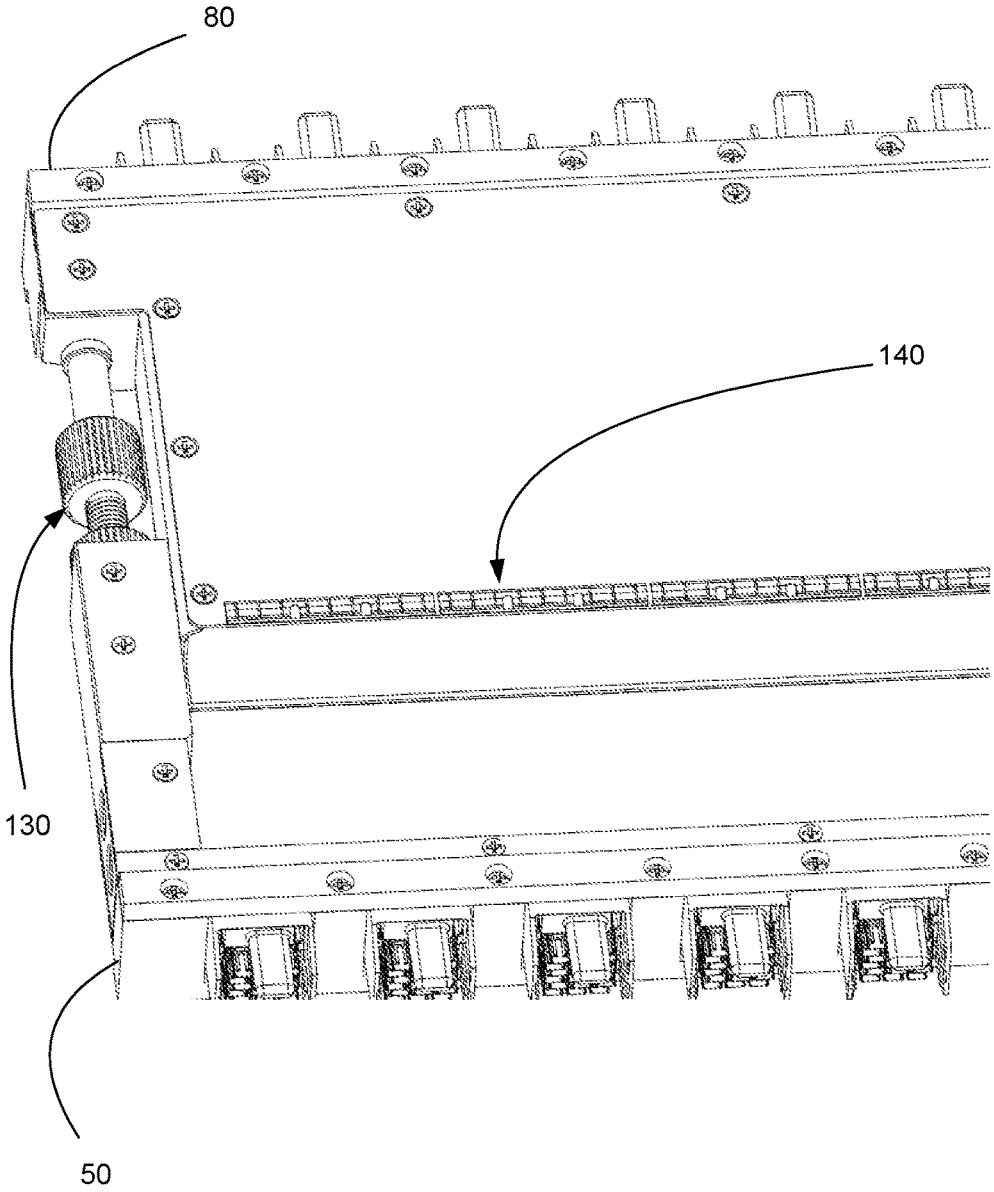
FIG. 12 illustrates a perspective view of an embodiment of a cable tray assembly that includes an electromagnetic interference gasket.

Due to the fact that the shell 80 is inserted into the shell 50, the interior cavities 58, 88 are in communication. This allows cables 40 to connect between connectors on the first and second faces and provide the flexibility suitable to allow the first and second faces to be adjusted in position, relative to each other. The depicted cable tray assembly design has the ability to expand and compress +/−20 mm from the nominal face to face dimension. This means that there is about 40 mm of difference between the first and second faces 60, 90 when the CAT 10 is in a compressed state, such as is depicted in FIG. 10 and an expanded state such as is depicted in FIG. 11. Naturally this amount can be varied based on customer needs. As can be appreciated, some of the limiting factors are the length of the cable and the size of the interior cavity (as the interior cavities will need to accept the extra cable when the CAT 10 is in a compressed state). In the embodiment depicted in FIG. 9, shoulders 59 and 89 act as limits for how far the shell 80 can be inserted into the shell 50.

The adjustment system can be configured as desired. In one embodiment a adjustment system 130 can be used. It has been determined that a shaft 132 with a threaded portion 36 and a thumbscrew 34 allows for desirable precision and control of the adjustment. An optional locking nut 138 can be used to prevent subsequent inadvertent adjustment (such as could be caused by vibration). If two adjustment systems are provided on opposite edges of the CTA 10 then it will be beneficial to adjust both together so that one shell does not become angled compare to the other shell. If less precision and control is needed then the adjustment system 140 with a telescoping shaft 142 can be used and the CTA 10 can be biased toward an expanded state if desired with a spring or other known biasing structure provided with the adjustment system 140.

Adjustability of the first and second faces 60, 90 helps solve issues of dimensional variability and can allow the CTA 10 to absorb positional variance of the mating assemblies. If sized correctly, the CTA 10 could be configured to even greater dimensional flexibility than the 40 mm noted above but given the additional cost of such a system, such a configuration would primarily be of interest in lower volume applications.

One issue that results from adjustability is that some electromagnetic interference (EMI) leakage may result. To help minimize EMI issues, the depicted design can provide EMI shielding via adhesive conductive foam gaskets on each some of the shell sides. These gaskets can be configured to be compressed against the chassis walls. Also, because the shells 50, 80 move in relation to one another, in an embodiment a spring finger gasket 140 can be provided to help provide shielding between the two shells 50, 80.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A cable tray assembly, comprising:

a first shell with a plurality of sides that define a first interior cavity, the first shell having a plurality of first connectors on a first face;

a second shell with a plurality of sides that define a second interior cavity, the second shell having a plurality of second connectors on a second face, the first and second face being on opposing sides of the cable tray assembly, wherein the first shell is configured to be inserted into the second shell so that the first interior cavity is in communication with the second interior cavity;

a plurality of cables connecting the plurality of first connectors to the plurality of second connectors and being positioned in the first and second cavities; and an adjustment system that is configured, in operation, to selectively control a distance between the first face and the second face.

2. The cable tray assembly of claim 1, wherein the adjustment system includes a threaded shaft that is rotatably mounted in the first and second shell, wherein rotation of the shaft causes a distance between the first face and the second face to be modified.

3. The cable tray assembly of claim 2, wherein the threaded shaft includes a thumb screw and a locking nut.

4. The cable tray assembly of claim 1, wherein the distance between the first and second faces can be adjusted 20 mm in either direction from a central position.

5. The cable tray assembly of claim 1, further comprising an electromagnetic interference gasket between the first shell and the second shell.

6. A cable tray assembly, comprising:

a first shell with a plurality of sides that define a first interior cavity and a first shoulder, the first shell having a plurality of first connectors on a first face;

a second shell with a plurality of sides that define a second interior cavity and a second shoulder, the second shell having a plurality of second connectors on a second face, the first and second face being on opposing sides of the cable tray assembly, wherein the first shell is configured to be inserted into the second shell so that the first interior cavity is in communication with the second interior cavity;

a plurality of cables connecting the plurality of first connectors to the plurality of second connectors and being positioned in the first and second cavities; and an adjustment system that is configured, in operation, to control a distance between the first face and the second face.

7. The cable tray assembly of claim 6, wherein the first shell can be inserted into the second shell so that the first shoulder is pressed against the second shoulder.

8. The cable tray assembly of claim 6, wherein the adjustment system is spring biased.

9. The cable tray assembly of claim 6, wherein the distance between the first and second faces can be adjusted 20 mm in either direction from a central position.

10. The cable tray assembly of claim 6, further comprising an electromagnetic interference gasket between the first shell and the second shell.

* * * * *